US008651491B2

(12) United States Patent
Schneider et al.

(10) Patent No.: US 8,651,491 B2
(45) Date of Patent: Feb. 18, 2014

(54) METHODS FOR PLAYING GAMES

(76) Inventors: Thomas A. Schneider, Scottsdale, AZ (US); Gregory P. Raymer, Raleigh, NC (US)

( * ) Notice: Subject to any disclaimer, the term of this patent is extended or adjusted under 35 U.S.C. 154(b) by 1 day.

(21) Appl. No.: 13/442,024

(22) Filed: Apr. 9, 2012

(65) Prior Publication Data

US 2012/0256377 A1 Oct. 11, 2012

Related U.S. Application Data

(60) Provisional application No. 61/472,908, filed on Apr. 7, 2011.

(51) Int. Cl.
*A63F 1/00* (2006.01)

(52) U.S. Cl.
USPC ..... 273/292; 463/13; 463/14

(58) Field of Classification Search
USPC ..... 273/292
See application file for complete search history.

(56) References Cited

U.S. PATENT DOCUMENTS

| | | | | |
|---|---|---|---|---|
| 7,556,561 | B2 | 7/2009 | White et al. | |
| 7,736,221 | B2 * | 6/2010 | Black et al. | 463/13 |
| 2005/0233791 | A1 * | 10/2005 | Kane | 463/6 |
| 2006/0121973 | A1 | 6/2006 | Parisien | |
| 2009/0093300 | A1 * | 4/2009 | Lutnick et al. | 463/26 |

FOREIGN PATENT DOCUMENTS

| | | | |
|---|---|---|---|
| AU | 2007202981 | A1 | 1/2008 |
| WO | 2007/010308 | A1 | 1/2007 |

* cited by examiner

*Primary Examiner* — Michael Dennis
(74) *Attorney, Agent, or Firm* — James G. Passé; Passé Intellectual Property, LLC

(57) ABSTRACT

The invention provides methods for playing games wherein players may select other players to make their playing decisions for them. The invention provides methods for playing games wherein primary players are playing a primary game, and derivative players are playing a derivative game, wherein the play of the game at said derivative table is identical to the play of the game at said primary table, and the players at the derivative table have selected a corresponding primary player to make their playing decisions for them. The present invention is especially well suited for playing the game of poker.

49 Claims, 1 Drawing Sheet

METHODS FOR PLAYING GAMES

This application claims priority of U.S. provisional application No. 61/472,908 filed on Apr. 7, 2011 and is included herein in its entirety by reference.

COPYRIGHT NOTICE

A portion of the disclosure of this patent contains material that is subject to copyright protection. The copyright owner has no objection to the reproduction by anyone of the patent document or the patent disclosure as it appears in the Patent and Trademark Office patent files or records, but otherwise reserves all copyright rights whatsoever.

FIELD OF THE INVENTION

This invention relates to new and improved methods for playing games. Of particular interest are new and improved methods for playing poker.

BACKGROUND OF THE INVENTION

As far back in time as modern man has been able to deduce his own history, well before the creation of writing, his ancestors have played games. Similarly, it is believed that man has bet on the outcome of games before the beginning of recorded history. Whether or not betting is involved, without a doubt game-playing is one of man's favorite ways to spend his time.

Many games involve physical skills, such as running, jumping, and engaging in activities that require great dexterity and physical ability. In addition to much practice, in order to become highly accomplished at such games, the player must have certain innate physical abilities. Contrarily, many other games involve essentially no physical skills, but only mental skills. Some might argue that some of these games require innate mental abilities in addition to much practice and learning, in order to be highly proficient. However, because there are no physical hurdles to be overcome, mental games are by far the most popular around the world. Such games include bridge, chess, backgammon, checkers, dominoes, go, scrabble, cribbage, gin rummy, and thousands of others, including, of course, poker.

Poker has existed in the United States in its modern form since the late 1800s, though many variations have been introduced since then. Poker-like games are believed to have existed as least as far back as the 15$^{th}$ century. Although the popularity of poker has grown almost continually since its American introduction in the 1800s, there was a tremendous increase in popularity in the early part of the 21$^{st}$ century. At this time, the first popular television shows featuring poker were created, and the availability of poker played online for real money brought both the awareness of the game, and the ability to easily play the game, to every adult. A player no longer had to be near a brick-and-mortar casino or poker room, or to arrange a gathering of players at a private location, in order to participate in a real money poker game. Online poker games also offered the chance to play for play money. This allowed a novice player to practice without monetary risk, and then move up slowly into the smallest real money games and eventually high-stakes real money games, after learning the rules and strategy.

Poker has been growing in popularity for over a century. In recent years, this popularity has exploded. It is estimated that hundreds of millions of people around the world play poker now. And a large fraction of those people also play poker online in virtual poker games, for play money or for actual cash. In addition to poker, many other competitive games of skill are commonly played around the world. Some of these games involve cards, while others involve dice or other implements. Examples of such games include backgammon, bridge, rummy, go, Othello, video games of all sorts, and the like.

Because all of these games are competitive, players are always looking for ways to improve their playing skills and more importantly their results. Players study books written by experts on the game, engage in discussion and debate in online forums dedicated to the game, watch training videos, and spend sometimes thousands of hours in practice and training The desire to improve one's abilities is even greater if the game in question is regularly played for real money, as is the case with poker.

High-stakes poker games have existed for decades, even centuries. These games are not played by very many players, because very few players have both enough money, and the willingness to risk that money, at such high stakes. However, even players who will never play for such large amounts of money enjoy tremendously the opportunity to observe these high-stakes games. There are several television shows dedicated to high stakes cash poker games, where players win or lose hundreds of thousands and even millions of dollars. There are many more television shows dedicated to poker tournaments, where players have paid anywhere from a three to six figures to enter the competition, and stand to win anywhere from four to eight figures in prize money. These television shows are watched by millions of viewers around the world. In the virtual world, there are many high stakes cash games and tournaments played all the time. And millions of people love to go to their favorite online poker room and watch these virtual games of poker. And though the games are virtual, being played online, the money being won and lost in some of these games is very real, and also can reach into the millions of dollars.

One reason viewers like to watch high stakes poker games is simply that they enjoy watching other people compete for sums of money that are beyond them. Another reason is that the viewers are themselves players, but do not have the money nor the skill to compete successfully in these high stakes games, but wish to watch the high stakes players so as to learn more about correct poker strategy, and thereby improve their own playing ability. In many cases, these players wish that they could play as skillfully as the players they enjoy watching in the high stakes games.

The following documents were published prior to Apr. 7, 2011: U.S. Pat. No. 7,736,221 entitled "Poker online playing system", PCT Publication WO/2007/010308 entitled "Betting on games using a betting exchange system", U.S. Patent Application Publication No. US 2006/0121973 entitled "Method, system and program product for monitoring an online card game to provide a summary view and/or real-time notifications", U.S. Patent Application Publication No. US 2005/0233791 entitled "System and method for conducting a game", Australian Patent Application No. AU 2007202981 entitled "System for facilitating participation in the outcome of competitive events", and http://forumserver.twoplustwo-.com/28/internet-poker/synthetic-sngs-bet-games-progress-966786/. All of these documents are hereby incorporated by reference herein in their entirety.

BRIEF DESCRIPTION OF THE INVENTION

The above-mentioned shortcomings, disadvantages and problems in the art are addressed herein by the present invention, which will be understood by reading and studying the following specification.

In one aspect, the present invention provides a method for playing poker, said method comprising playing poker at a primary table consisting of two or more primary players, wherein said primary players at said primary table make their own playing decisions; and playing poker at a first derivative table consisting of two or more derivative players, wherein each of said derivative players at said first derivative table has a corresponding primary player at said primary table, and further wherein said derivative players at said first derivative table are dealt the same cards as their corresponding primary players at said primary table, and wherein the playing decisions of said derivative players at said first derivative table are exactly the same as the playing decisions made by their corresponding primary players at said primary table.

In a second aspect, the present invention provides a method for playing poker, said method comprising playing poker at a primary table consisting of two or more primary players, wherein said primary players at said primary table make their own playing decisions, and playing poker at a first derivative table consisting of two or more derivative players, wherein each of said derivative players at said first derivative table has a corresponding primary player at said primary table, and further wherein said derivative players at said first derivative table are dealt the same cards as their corresponding primary players at said primary table, and wherein the playing decisions of said derivative players at said first derivative table are exactly the same as the playing decisions made by their corresponding primary players at said primary table, further wherein said derivative players have the option to not make the same playing decisions made by their corresponding primary player, but to make a different decision of their own choosing.

In a third aspect, the present invention provides a method for playing poker, said method comprising playing poker at a primary table consisting of two or more primary players, wherein said primary players at said primary table make their own playing decisions, and playing poker at a first derivative table consisting of two or more derivative players, wherein each of said derivative players at said first derivative table has a corresponding primary player at said primary table, and further wherein said derivative players at said first derivative table are dealt the same cards as their corresponding primary players at said primary table, and wherein the playing decisions of said derivative players at said first derivative table are exactly the same as the playing decisions made by their corresponding primary players at said primary table, further wherein said derivative players have the option, on the final decision of each hand of poker in said primary game, to not make the same playing decision made by their corresponding primary player, but to make a different decision of their own choosing.

In a fourth aspect, the present invention provides a method for playing poker, said method comprising playing poker at a primary table consisting of two or more primary players, wherein said primary players at said primary table make their own playing decisions, and playing poker at a first derivative table consisting of two or more derivative players, wherein each of said derivative players at said first derivative table has a corresponding primary player at said primary table, and further wherein said derivative players at said first derivative table are dealt the same cards as their corresponding primary players at said primary table, and wherein the playing decisions of said derivative players at said first derivative table are exactly the same as the playing decisions made by their corresponding primary players at said primary table, and further wherein a first primary player can optionally elect to have his corresponding derivative players vote as to which decision said first primary player will make.

In a fifth aspect, the present invention provides a method for playing a game, said method comprising playing said game at a primary table consisting of two or more primary players, wherein said primary players at said primary table make their own playing decisions; and playing said game at a first derivative table consisting of two or more derivative players, wherein each of said derivative players at said first derivative table has a corresponding primary player at said primary table, and further wherein the play of said game at said first derivative table will be identical to the play of said game at said primary table, and wherein the playing decisions of said derivative players at said first derivative table are exactly the same as the playing decisions made by their corresponding primary players at said primary table.

In one aspect, embodiments provide methods for improving the ability of people to play games. In particular, embodiments provide methods for improving the ability of people to play poker. More specifically, embodiments provide methods for improving the ability of people to play games by permitting these people to select another (presumably more skillful) player to make their playing decisions for them.

In another aspect, embodiments provide methods for improving the ability of people to play games by permitting these people to select another (presumably more skillful) player to make their playing decisions for them, but with the option to sometimes choose to make their own decisions rather than accept the playing decisions made for them by the selected other player.

Methods of varying scope are described herein. In addition to the aspects and advantages described in this summary, further aspects and advantages will become apparent by reference to the drawings and by reading the detailed description that follows.

For reasons stated above, and for other reasons stated below which will become apparent to those skilled in the art upon reading and understanding the present specification, there is a need in the art for improved methods for playing games.

DETAILED DESCRIPTION OF THE INVENTION

Figure 1:
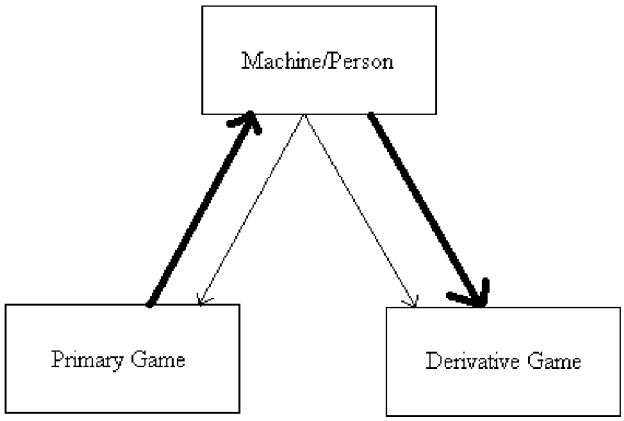
FIG. 1 is a flowchart showing the movement of information between the primary game, the derivative game, and the software/computer running the games.

While this invention is susceptible to embodiment in many different forms, there is shown in the drawings and will herein be described in detail specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings. This detailed description defines the meaning of the terms used herein and specifically describes embodiments in order for those skilled in the art to practice the invention.

The terms "about" and "essentially" mean±10 percent.

The term "comprising" is not intended to limit inventions to only claiming the present invention with such comprising language. Any invention using the term comprising could be separated into one or more claims using "consisting" or "consisting of" claim language and is so intended.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "one embodiment", "certain embodiments", and "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

The drawings featured in the figures are for the purpose of illustrating certain convenient embodiments of the present invention, and are not to be considered as limitation thereto. Term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein and use of the term "means" is not intended to be limiting.

Embodiments are described in sufficient detail in the following detailed description to enable those skilled in the art to practice the embodiments, and it is to be understood that other embodiments may be utilized and that logical, mechanical, ii electrical, programming and other changes may be made without departing from the scope of the embodiments. The following detailed description is, therefore, not to be taken in a limiting sense.

FIG. 1 is a flowchart showing a method for playing games according to an embodiment of the present invention. FIG. 1 depicts the movement of information between the machine/person running the games to and from the primary game and the derivative game. More specifically, FIG. 1 shows the machine/person that is running the games, as well as showing a primary game and a derivative game. The thin lines show the movement of information about the game from the machine/person to both the primary and derivative games. This information includes the cards being dealt, dice being rolled, and the like. The thick lines show the movement of information about playing decisions. The playing decisions are made by the primary players in said primary game, and this information moves to the machine/person running said games, and then this information about said playing decisions moves from said machine/person to said derivative game.

Figure 2:
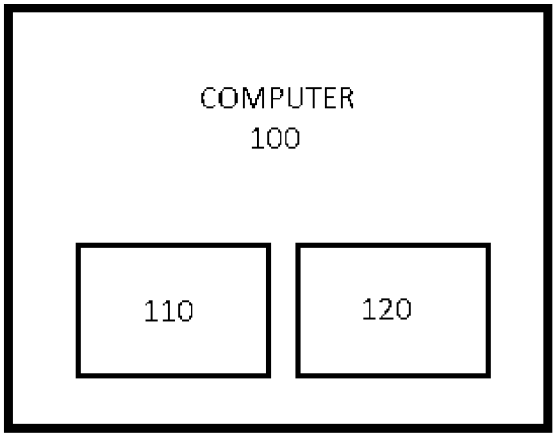
FIG. 2 depicts an exemplary computer for performing the process(es) of the invention.

FIG. 2 depicts a computer 100 having means, such as a processor 110, for performing some or all of the method steps/process(es) of the invention. A computer program product comprises a computer readable medium 120, such as a memory, that stores code for causing the computer to perform some or all of the method steps/process(es) of the invention.

As used throughout this document, the term "real money" refers to cash, tokens being used in place of cash (e.g., poker chips), or any items that have recognizable and actual cash value that is not a de minimus amount. The term real money also includes the use of real money in online game playing, where the players are betting virtually, but the result of the game is reflected in the value of their account on the website running the game, wherein the value of their account is readily convertible to real money. The term real money also includes the use of play money when the play money is being used to keep score, and wherein real money is being wagered on the results of the game being scored using play money. Such use of play money that falls within the meaning of real money includes tournament play wherein the chips or tokens being used in the tournament have no direct cash value, but the tournament is being contested for real money; such use of play money that falls within the meaning of real money also includes fantasy poker competitions. The term real money includes any and all forms of currency, including U.S. dollars, the Euro, the British pound, Japanese yen, and the like.

As used throughout this document, the term "play money" refers to points or amounts being bet by players that have no cash value. That is, the players are winning and losing points that have no cash value, even if those points are being referred to by words like dollars or the like. It is common practice for many game playing sites online to give players play money with which to play in the games offered by that site. Commonly, if the player loses all of the given play money, the site will automatically give them more so they may continue playing. The key distinction between play money and real money is that real money either is in the form of cash, or it is in a form that is easily convertible to a specific amount of cash, whereas play money has no inherent cash value, cannot be easily converted to cash, and even if it is offered for sale, is not worth any specific amount of cash. The fact that two persons might agree to a transfer of one million play dollars on a site in exchange for ten dollars of real money does not mean that the play dollars in question are real money. In this example, the one million play dollars are still play money, despite their sale for cash.

As used throughout this document, the term "private cards" refers to cards that are not viewable by any person other than the primary player who possesses those cards as part or all of their poker hand. In contrast, "public cards" refers to cards that are viewable by all persons involved in the game, as well as any persons observing the game. Thus, in a poker game like Texas holdem, each primary player is dealt two private cards at the start of each hand. As the hand progresses, the dealer reveals up to five community or board cards, which are public cards to be used by all players contesting the pot. The private cards dealt to each primary player remain private cards until showdown at the end of the hand, at which time all primary players who haven't folded reveal their private cards to determine who holds the winning hand, and thus wins the pot. In this manner, these two private cards remain private cards during the hand, and remain private cards forever if folded before the end of the hand, but become public cards if showdown is reached by the primary player. It is also possible that even if a primary player reaches showdown in a hand, his private cards might remain private cards. For example, if a first primary player reveals his private cards at showdown, and a second primary player cannot beat the hand of the first primary player, the second primary player can optionally choose to not reveal his private cards, by folding them and conceding victory to the first primary player. In this situation, even though the second primary player reached showdown, his private cards will remain private cards. This option to fold private cards at showdown sight unseen exists in many poker games, though not all of them. In some games, it is mandatory that all players who reach showdown reveal their private cards every time.

In a game of poker like seven card stud, each primary player is initially dealt two private cards facedown, and one public card faceup. If a player does not fold, they will be dealt three more public cards faceup, one at a time, and then a seventh private card facedown. Just as in Texas holdem, if showdown is reached, all remaining primary players will reveal their three private cards, thus making them public cards, and see who has the winning poker hand. In a game like five-card draw, each primary player is initially dealt five private cards and zero public cards. At the conclusion of the hand, if showdown is reached, again all remaining primary players will then reveal their five private cards, thus making them public cards. No matter what form of poker is played, there are always private cards held by each primary player, and sometimes public cards ii held by each player or shared by all players. At the end of the hand, when showdown is reached, unless it is a permissible option selected by a primary player to fold his private cards unseen, all remaining primary players will reveal their private cards and thus make them public cards.

As used throughout this document, the term "table" refers to the location or playing field where the underlying game is being played, whether that game is a live game in the physical world, or virtual game in the online world. In live poker, table has its common meaning, and refers to the table where the players are seated, and whereupon the cards are dealt and the bets are made. In online poker, table refers to the virtual table presented on a video screen that is a representation of a physical counterpart. Also included in the meaning of poker table are electronic tables, tables where people sit together at the same physical table, but the game is played on a computer and displayed on a monitor(s) built into the physical table where the players are seated. In other games, table might refer to the board for a backgammon or checkers game, the surface upon which dominoes are placed for a dominoes game, and the like.

As used throughout this document, the term "primary player" refers to a player who is playing the game, and who is himself making all of the playing and betting decisions of the game. The primary player is typically playing completely independently of any derivative players who might be making use of his skill to play their own separate derivative game. Although not necessary to the practice of the present invention, the primary player will often be playing for much larger amounts of money than any of the individual derivative players who have selected him to be their primary player. The game in which the primary players are competing is referred to as the "primary game", and it takes place at the "primary table".

As used throughout this document, the term "derivative player" refers to a player who is playing the game, but who is having all of his playing and betting decisions made by a corresponding primary player. The derivative player is given the same cards or other game indicia as the selected primary player, and typically must make all of the same decisions as the primary player. However, in some embodiments of the present invention, the derivative player may sometimes have the option to not make the same decision as their corresponding primary player. It is expected that typically the derivative players will be playing for stakes that are significantly lower than those of their primary players, though this need not be so. The game in which the derivative players are competing is referred to as the "derivative game", and it takes place at the "derivative table".

As used throughout this document, the term "hand" refers to one of two things. In some uses, hand refers to the combination of public and private cards being held by an individual player. In other uses, hand refers to a single deal of a game of poker. That is, hand indicates one game that is played from the shuffling and dealing of the cards, through to the end of that game when a winner(s) of that game is determined. When the cards are then being shuffled again, the current game or hand is then ended, and the next game or hand will then begin.

As used throughout this document, the term "live" refers to a game being played by contestants who are physically present in the same real world setting. The term "live" does not require that the actual play of the game occurs completely within the physical world, but also encompasses the use of computerized or virtual means of players competing with one another, so long as the players are physically present in the same real world setting. The size of this setting could vary dramatically depending upon the game being played, and the players are not required to be close enough to touch or even see one another directly, unless the game itself has such a requirement. For example, if players are playing poker via the use of an e-table (see, for example, U.S. Pat. No. 7,556,561), this would be considered live play according to the present invention.

As used throughout this document, the term "online" refers to a game being played by contestants who are competing with one another using computers and software through an internet connection. While such players might be physically present in the same real world setting, it is completely unnecessary for them to be in such physical proximity in order to play the game in progress. For example, while an e-table enables game play through the use of computers and software and negates the need for cards, chips, and other physical game tokens, game play on an e-table is considered live as the players must be physically present to interact with the e-table and make their game play decisions. Contrarily, even if two players were sharing the same computer to compete in an online game, it would still be considered online and not live play according to the use of those terms as defined in the present invention, as this online game could have been played with the players in physically separate locations.

The staking or backing of poker players is a practice known to the art. Most commonly, a person hereinafter referred to as the "backer" will pay all or a portion of the costs of playing a real money poker game, this game to be played by a second person hereinafter referred to as the "stakehorse". The stakehorse plays the real money game, be it a cash game or a tournament, or a series of such games, using this money provided by the backer. At the end of the playing session or sessions, any money due to the backer is returned to him, including potentially a profit. For example, a backer might provide funds to a stakehorse in the amount of $1000 dollars to play a real money game of no-limit Texas holdem for one evening. The agreement between the backer and the stakehorse could indicate that the stakehorse would play this game for one evening, and at the end thereof if the stakehorse lost money, any remaining funds would be given in their entirety to the backer. However, if at the end of the evening the stakehorse had won money in the game, then the stakehorse would be entitled to an agreed portion of the money won, for example, 20%. Thus, if the result were a loss of $200, then the backer would be returned $800, the amount of the stake remaining Contrarily, if the result were a win of $500, then the backer would be returned the entire $1000 starting stake, plus 80% of the profit, or a total of $1400. In this example, the stakehorse would receive the remaining 20% of the profit, or $100.

Of course, a single stakehorse might have multiple backers at the same time, each of these backers having a separate portion of the stakehorse's action for which they provided money. It is a somewhat common practice for players, especially in tournament poker, to sell a portion of their action to multiple backers. An example would be a player selling 10% of his action to a backer in exchange for money equal to 10% of the cost of entering the tournament. This same player might sell another 10% (or more, or less) of his action to other backers in the same tournament. It is also common for players who are entering the same tournament to trade a portion of their action with one another. For example, the two players might trade 2% of their action with one another, making each of them a backer of the other in the amount of 2%, as well as making each of them a stakehorse of the other in the same amount. If one player were to win the tournament for $1,000,000, and the other player failed to make any money, then the winner would owe 2% of this amount, or $20,000, to the other player.

Another practice known to the art is cross-booking Cross-booking involves players in the same game or tournament, being played for real money, wagering against one another on their respective results in that game or tournament. For example, players A and B are both participating in a real money game of seven card stud poker. For any of a variety of reasons, these players choose to make a cross-booking bet with one another. Thus, at an agreed time, or possibly whenever either player chooses to end the bet, each player must match the results achieved by themselves and the other player. Thus, for example, if player A were winning a total of $400 at the end of the bet, then player B would owe player A an additional $400, matching the $400 that player A won in the normal course of the game. If, for further example, at the same time player B were losing $100 at the end of the bet, then player A would have to match this amount. But, since the result of player B is a negative number, this would mean that player B owes that amount to player A. Thus, in this example, as a result of the cross-booking bet, player B would owe Player A a total of $500. It is also known in the art that players might choose to make a cross-booking bet for a percentage of the action in the regular game or tournament, wherein this percentage might be less or more than 100%. Thus, using the example above, if the cross-booking bet were for 10%, then player B would have lost only $50 in the cross-booking bet. If however the cross-booking bet had been for 1000% (or 10×the action), then player B would have lost only $100 in the regular game, but would have lost $5000 in the cross-booking bet to player A.

Sports betting is one of the most common forms of wagering in the world. Simply put, a person makes a bet on the outcome of a sports contest. Typically these bets are made against a sportsbook, who either gives odds to the bettor, or makes the bettor pay more than even money on a bet that is supposedly a 50:50 proposition. Similar to sports betting, it is also occasionally possible to wager on the outcome of a non-athletic contest being played by others. For example, prior to the beginning of the NBC National Heads-Up Poker Championship each year, once all 64 contestants are known, there are websites that will accept wagers by customers who predict the winner of the tournament. This form of betting is similar to that commonly done in sports like baseball and football, where bettors can place bets on which team will win its respective championship. This form of betting is very different than that of the present invention, since in sports betting the bettor places the bet with a sportsbook, an agent who accepts the wager and gives a certain price or odds on the bet at the time the bet is made. Once a sports bet is made, the bettor knows exactly what he might win or lose on the given bet. For example, in sports betting it is common to bet $110 to win $100 on the outcome of a sports game between two teams. Frequently, either the bettor or the sportsbook is giving points to the other side of the bet. However, whatever the details of the bet, the bettor knows that he will either lose $110, win $100, or tie and break even. No other outcome is possible.

In contrast, the methods claimed in the present invention involve a derivative player who plays a separate game from that of a primary player, but wherein the derivative player uses the skills of the primary player to make their playing decisions for them. While the derivative player can decide at what stakes he wishes to play the derivative game, and can further decide how much money to put at risk on his derivative play, he cannot know at the start of each hand how much of the money he has put at risk will go into action. For example, the primary game might have betting limits of $100 and $200 dollars on each betting round, and the derivative player has chosen to play at limits of $1 and $2 while selecting player A in the primary game as his primary player. If player A currently has $10,000 in play, and the derivative player matches this amount by putting $100 on the table in his derivative game, he still does not know how much of that $100 will be put at risk each hand. For any given hand, primary player A may put no money, his entire $10,000, or anything in between, into the primary pot. This means that the derivative player may also lose any amount from $0-100 on each hand, or win a corresponding amount. The derivative player can presumably start his session at the beginning of any hand, as well as quit his derivative game at the end of any hand, but until the hand is over (or primary player A has folded), the derivative player cannot know how much he might win or lose that hand.

Race betting is also a common practice known to those of skill in the art. This form of betting is similar to sports betting, insomuch as bettors choose to make bets upon which of two or more competitors will win a race, be it a horse race, dog race, jai alai game, or the like. Unlike sports betting, race bettors do not know what price or odds their bet will pay until just prior to the start of the contest upon which they are betting. This is because race betting makes use of a system known as parimutuel wagering. Under this system, the odds which are paid to winning bettors at the end of a successful race depends upon the amount of money bet on their chosen contestant, as well as the amounts bet on every other contestant in the race. Thus, if half of the total money bet were on a single contestant, who then won the race, any bets made on that contestant would effectively yield a payoff of 2:1, or double the amount of money bet (in practice it would be less than this, as the organization administering the race and accepting the bets typically keeps a percentage of the entire betting pool, commonly 17% in horse race betting in the United States). Contrarily, if the bet were made on a contestant on whom very few other people made a bet, then when that contestant won the race, those betting on that contestant might be paid 10×, 100×, or an even larger multiple of their bet. Therefore, like sports betting, a race bet involves a fixed amount of money put at risk which might be lost, but unlike sports betting, the race bettor does not know until just before the race starts how much his bet might win. Still, race betting is very unlike the present invention, in that there is no derivative race occurring at the same time as the primary race, and the derivative players of the present invention do not know at the start of each hand how much they are putting at risk, nor how much they might win.

Another practice known in the art is sometimes referred to as "capping" or making a "kum-kum" bet. In this practice, a player is playing a house game such as blackjack or baccarat, and another player makes an additional bet taking the same side as the original player. As an example, the original player might wager $100 on the next hand of blackjack, and another player adds $10 on top of the original bet. If the original player wins that hand of blackjack, $100 is paid to the original player, and $10 paid to the capping player. Capping always takes place in house games where the players are betting against the dealer, or house. Similar to sports betting, the capping player knows exactly how much money he might lose, and typically how much he might win. Also, unlike the presently claimed invention, the capping player is not playing in a separate derivative game, but is directly participating in the primary game.

The present invention enables players to do more than just watch a high stakes poker game. By practicing an embodiment of the present invention, these players can play a game of poker against other players, and do so at the same skill level as their chosen high stakes primary player. Of course, it is not thereby guaranteed that they will win in their derivative game, as their opponents in the derivative game are having their decisions made for them by their own chosen primary player in the primary game. However, especially if the derivative player is a very novice player, he will often have a higher expectation of winning by playing in a derivative game against other derivative opponents, as compared to playing in a regular game against the same opponents, wherein he and all of his opponents are making their own playing decisions.

High stakes poker games are commonly played all the time on the many online poker sites in current operation. Because these games are run by computer programs, it is possible for these online sites to offer thousands of tables of games simultaneously. It is also possible for these computers, if so programmed, to deal the same cards to multiple tables. In one embodiment of the present invention, a primary game of poker is being played at a primary table. There are two primary players at said primary table, designated primary player A and primary player B, and they are playing a normal game of online poker for high stakes. As is typical, this game is being watched by thousands of interested observers. However, if any observer should choose to do so, they can instruct the software running the games to create a new table that is a first derivative table of the high stakes game. Not only does this observer cause the creation of said first derivative table, but he also selects at what stakes he will play poker at said first derivative table. These selected stakes can be any proportion of the stakes at said primary table, and could even be for play money instead of real money. Finally, this observer selects a primary player at said primary table, and becomes the first derivative player of said primary player at said first derivative table.

Now that a first derivative table has been created, and a first derivative player is seated at said first derivative table, and is ready to have primary player A make his decisions for him, he must wait for somebody else to join his derivative game. Whenever somebody else wishes, they may join the game at said first derivative table. However, because primary player A already has a derivative player A at said derivative table, this newcomer can only play as the first derivative player of primary player B. If he makes the decision to join said first derivative table as said first derivative player B, then play will commence on said first derivative table.

The play on said first derivative table will be exactly the same as the play on said first primary table. Players A and B at each table will be dealt the same cards. Primary players A and B will make all decisions about whether to check, bet, raise, or fold. Derivative players A and B will have the same decisions made for them by their respective primary players. As such, derivative players A and B will win or lose the same pots as their respective primary players. And they will win or lose the exact same amounts of money as well, except they will do so at the selected proportional stakes of their first derivative table.

At the same time that play is continuing on said primary table and said first derivative table, it is possible that another player decides to play in a second derivative game of said primary game. By inputting the appropriate instructions to the software running the games, this player can cause the creation of a second derivative table of said primary table. As was done previously to create said first derivative table, this player selects the stakes of the game to be played at said second derivative table. The stakes at said second derivative table can be of any amount, the same or different, as compared to said first derivative table. This player also chooses whether his primary player will be said primary player A or said primary player B, and in doing so he thereby becomes the second derivative player A or second derivative player B. After doing so, he then waits for somebody to select the other primary player at said second derivative table, thus becoming the other second derivative player A or B. Once this happens the derivative game will commence on said second derivative table. Even though the stakes may be different, and different people may be playing as said second derivative players, there is nothing significantly different about said first derivative table and said second derivative table. On both tables, the same cards will be dealt to the derivative players as are being dealt to their respective primary players. And on both tables, the decisions made by each derivative player will be the same as their respective primary players.

There is no theoretical limit to the number of derivative tables that can exist at any one time. Practical limitations will include the capacity of the software program being used, the capacity of the computers running said software, and the bandwidth of communication connecting said computers to the players. And of course there is no theoretical reason that a given individual person cannot be a derivative player at an unlimited number of derivative tables.

In fact, there is no reason that a given individual cannot be a derivative player of different primary players at these different tables. For example, this individual could be derivative player A at one derivative table, and derivative player B at another derivative table. Taking this further, there is no reason that this individual couldn't be a derivative of player A and of player B at the same derivative table. Similarly, there is no reason that a primary player could not be a derivative player of himself, or a derivative player of other primary players in his primary game.

In a preferred embodiment of the present invention, said primary game is a high stakes cash game. However, said primary game could also be a game of tournament poker. Likewise, said primary game need not be a high stakes game, but could be played for any amount, even for play money.

One issue facing the participants in a derivative game is when should play begin in said derivative game. Obviously it is possible that as soon as there are two or more derivative players in said derivative game, the derivative game will commence with the start of the next hand played in the corresponding primary game. However, practicing the invention in this manner could present certain problems. For example, in many of the most popular forms of poker, some of the players are required to post blind bets (or blinds) before the cards are dealt. In the primary games, there are typically rules in place as to when a new player is permitted to join an existing game, and how much money, if any, it will cost him to join if he does so in an advantageous position with respect to the blinds. If a primary game is just starting for the first time, the location of the blinds is typically determined by some random method. However, a derivative game can potentially start at any time, not just when the primary game starts. Also, if derivative players leave a derivative game, this does not directly affect the primary game; nor does it directly affect the primary game if new derivative players join a derivative table that is playing in correspondence with an ongoing primary game. However, if there are no rules as to when derivative players can join or quit a derivative game, some of them might choose to only select primary players for those hands where the primary player is not being forced to post a blind bet (and thus they will not have to post a blind bet in their corresponding derivative game). Obviously, this will result in an advantage for such derivative players, and correspondingly a disadvantage for the derivative players who are not avoiding the payment of blind bets in this manner. As such, it would be advantageous to put in place rules governing when derivative players are allowed to join and/or quit derivative games.

In one embodiment of the present invention, derivative players are only allowed to join a derivative game in progress when their corresponding primary player is in the most disadvantageous position with respect to any mandatory bets, such as blinds. In the case of poker games such as holdem and Omaha, the derivative players would only be allowed to join a derivative game when their corresponding primary player is in the big blind position. Because the derivative players are forced to start a new game in this most disadvantageous position, they will not be able to easily take advantage of the placement of blinds in a manner that disadvantages other derivative players.

In another embodiment of the present invention, if the derivative game is not presently in action, then the start of the derivative game (once two or more players have joined the derivative game, and have thus made it possible for it to begin) will be determined by a random method. For example, if the primary game is being played heads-up, then whenever there are not corresponding derivative players for both primary players, then there is no active derivative game. Once the second derivative player joins the derivative game, the game can commence on the next hand dealt in the primary game. However, if this is done immediately on every occurrence, then again there might be derivative players who will choose to only enter a derivative game when their corresponding primary player is in the superior position in the primary game. And then this derivative player might choose to quit the derivative game after participating for just that single hand. One means to nullify this strategy is to require that the derivative players participating in a new derivative game must stay for at least one hand of the new derivative game, and to determine the start of the new derivative game, relative to the primary game, in a random manner such that the derivative players cannot know if their primary player will be in the superior or inferior position for this first hand of the new derivative game. If the primary game is being played heads-up, then the software running the derivative game could randomly determine whether the derivative game starts on the next possible hand from the primary game, or the second next possible hand. If these two possibilities are randomly selected half of the time, then the derivative players cannot take advantage of the superior or inferior position of their selected primary player.

The practice of the present invention includes derivative tables wherein said derivative players can see only the public cards dealt on said derivative table, as well as derivative tables wherein said derivative players can see the public cards as well as the private cards dealt to them. In one embodiment of the present invention, said derivative players will only ever be shown the public cards of their corresponding primary player. In another embodiment of the present invention, said derivative players will be shown the public cards as well as the private cards of their corresponding primary players in real time. If this latter embodiment of the invention is being used, it will be preferable to sequester the primary players such that they cannot know the private cards of their primary player opponents. Otherwise, it might happen that a first primary player, who is competing for high stakes, would become a derivative player of a second primary player, and thus learn the private cards of said second primary player, and use such information to provide himself an almost insurmountable advantage in said primary game.

In another embodiment of the present invention, said derivative players are shown the public and private cards being dealt to them in real time, wherein the corresponding primary table was pre-recorded. In this embodiment, it is now impossible for the primary players to know the private cards of their primary player opponents due to participation in derivative games. Of course, this embodiment has the disadvantage that the derivative games are being played at a time when the primary players know the outcome of the underlying primary game. As such, it might be preferable to sequester the primary players at the conclusion of said primary game until said derivative games are completed, or to otherwise insure that this information does not get transmitted to any of said derivative players.

In another embodiment of the present invention, said derivative players are shown the public and private cards being dealt to them as they play each hand of the derivative game, wherein there is a one-hand delay between the primary game and the derivative game. By using this embodiment, the derivative games and the primary game can almost be played simultaneously, but because the start of each hand on said derivative tables does not begin until after the completion of each hand on said primary table, there is no opportunity for derivative players (who could potentially also be primary players) to learn the identity of private cards until the hand is completed in said primary game. This embodiment permits said derivative players the full enjoyment of seeing all of the public cards and their private cards from the beginning of each hand, without necessitating sequestering said primary players. However, it still would be advantageous to somehow prevent communication by said primary players during a hand, as even such partial information about a hand in progress could be useful to said derivative players in choosing whether or not to join a derivative game, and as to which primary player to choose to play for them. Of course, such a concern could also be dealt with by locking each derivative player in for the next hand, that is, once a given hand is begun on said primary table, the corresponding derivative players cannot quit their corresponding derivative game prior to the conclusion of said given hand on their corresponding derivative table. This option would prevent said derivative players from making any worthwhile use of such advance information, even if they were able to obtain it. In an alternative version of this embodiment, instead of cards being shown on a one-hand delay, they are shown on a longer delay, such as two, three, or more hands. Instead of the delay being based upon a certain number of hands, the delay could be based upon an amount of time.

In another embodiment of the present invention, instead of showing the private cards of the primary player to the corresponding derivative players in real time as they are playing the hand, the private cards could instead only be revealed at the conclusion of each hand. Thus, these private cards remain private throughout the play of each hand of the primary and derivative games, but are then shown (whether or not they become public cards as defined herein) to said derivative players at the conclusion of each hand. This embodiment prevents the need to sequester primary players so as to prevent the improper exchange of information. However, it is likely that a majority of derivative players will prefer to see the private cards dealt to them while the hand is being played, rather than after.

In another embodiment of the present invention, private cards are never shown to derivative players, unless they elect to pay a designated fee to their corresponding primary player for this privilege. In this manner, curious derivative players can satisfy their curiosity, while derivative players who prefer to keep more money can do so. If this embodiment is being practiced, the cards that are paid to be shown can be shown in a manner and with the timing of any of the methods discussed herein, as well as in other manners understood to those of skill in the art.

In many cases, derivative players would not want to play if they were not at their computer watching their derivative game. One benefit of the present invention is that people could play as derivative players, and learn how to become more skillful by observing the playing decisions of their primary players who are playing for them. However, some people would want to play as a derivative player in certain situations, even if they are not at their computer to observe, nor even logged into the website running the games. As discussed above, some fans would want to play as a derivative of certain pros, even if said fan is not online at the time that said primary game occurs. In one preferred embodiment of the present invention, the software running said derivative games will allow a derivative player to set up a set of rules or instructions wherein said derivative player will instruct said software to automatically enter said derivative player into said derivative games whenever specified criteria are met. With enough detail in the instructions, said derivative player could ensure that almost anytime he would select to play as a derivative player if he were observing the primary games himself, the software would automatically make him exactly such a derivative player.

In many cases, poker fans have favorite well-known professional players whom they admire, and whom they consider the best or most talented poker player. For this or other reasons, the fan may wish that he could be a derivative player of said pro whenever said pro is a primary player. However, since said fan likely will not know each and every time that said pro is available as a primary player, said fan will miss many such opportunities. In an embodiment of the present invention, the software running the games would provide an option wherein said fan would be able to create a set of instructions within said software, instructing said software to create and/or to join derivative games wherein said fan will be the derivative player of said pro whenever said pro is a primary player. Of course, more generally, software could be programmed to provide an almost limitless set of parameters for the fan to dictate under exactly what conditions he chooses for the software to automatically include him in a derivative game or games.

In one embodiment, said fan could instruct the software to automatically make said fan a derivative player of a specific pro on any occasion when said pro is a primary player. Alternatively, the instructions could limit the selection of said pro as the primary player to only those times said pro is playing in primary games featuring a certain form(s) of poker. For example, said fan might consider said pro a smart selection as a primary player, but only if said pro is playing no-limit Texas holdem, but not when said pro is playing pot-limit Omaha.

Similarly, said fan could instruct said software to only use said pro as a primary player when said pro is playing in games of certain betting limits. For example, maybe said pro is known to do well when playing 200-400 no-limit Texas holdem, but not so well when playing 1000-2000 no-limit Texas holdem.

Even as some fans consider some pros to be great high stakes players, they might consider other pros to be very weak players. In such a case, if said weak pro were playing in a primary game, said fan might want to become a derivative player of every other primary player in said primary game. Similarly to the above, wherein said fan does not want to miss any such opportunities, said fan could instruct said software to automatically make said fan a derivative player of anybody who is competing against said weak pro in said primary game. Even if said fan doesn't want to select any and all opponents of said weak pro as his primaries, said fan might select certain pros as his primary player, but only when those certain pros are competing against said weak pro.

In addition to setting the software to select which primary players in which games for automatic derivative play, a customer could use said software to set parameters as to how many derivative games to join, at what derivative stakes, and how much of his bankroll to put at risk in each individual derivative game as well as in all derivative games that he is automatically joining Bankroll limits could be set as specific numbers, or as percentages of the total available bankroll.

Moreover, in another embodiment of the present invention, said customer could choose to set up priorities amongst several different automatic selection parameters. For example, a customer might choose to select a first primary player under certain conditions, and with certain bankroll limitations. The same customer might also have created automatic criteria for selecting a second primary player, a third, and so on. However, if several of these automatic selections are concurrently available, the automatic selection parameters might exceed the derivative player's available bankroll, or the bankroll limitations he has created. To most effectively deal with such situations, said derivative player could set up priorities amongst his automatic criteria. Thus, if there are three primary players available, all of whom would normally be selected by the automatic criteria of said derivative player, the software could select one or more of said available primary players and not select others, based upon the priority criteria created in advance by said derivative player.

Similarly, in another embodiment of the present invention, said derivative player could create stop-loss and stop-win limitations for the automatic selections. For example, a stop-loss instruction could be as simple as do not lose more than $X between now and the next time I log on. In such a case, if the total stop-loss limit of $X had been reached, said derivative players automatic selection criteria would no longer be active. Stop-loss limits could also be more specific, and exist for each individual derivative game in which said derivative player is automatically participating, for each individual primary player being automatically selected by said derivative player, for each time period in which derivative games are automatically being played, and the like. Contrarily, said derivative player could set a stop-win limit, such that whenever a certain amount of profit had been reached, further automatic derivative play is discontinued so as to "lock-up" the win. In another embodiment, said derivative player could create automatic notification conditions, wherein the software communicates to said derivative player via email, text messaging, instant messaging, or the like, whenever certain selected criteria are met. In this case, said derivative player will be informed of his results in part or full, on an ongoing basis, whenever and as he has directed the software to do.

Those of ordinary skill in the art will understand that there are almost limitless different criteria that said derivative player could use in determining which derivative games to play, and which primary player(s) to select. And as such, there are almost limitless criteria that said software could make available to said derivative player for his automatic participation in derivative games.

Whenever a potential derivative player is considering playing in a derivative game, he must make many decisions as to which primary player to select, at what proportional stakes of the primary game he wishes to play, how much total money to put at risk, and more. Depending upon how the software works, this might require said derivative player to scroll through dozens, hundreds, even thousands of derivative games to find a derivative game at the desired stakes wherein his desired choice of primary player is available. Preferably, said derivative player would not have to deal with these difficulties. Instead, in a preferred embodiment, said software would permit said derivative player to input his desired selections of primary player, amount of money to risk, and the like, and automatically search through any and all existing derivative games to find those which match the criteria set by said derivative player. Said software would then automatically place said derivative player in said derivative games, and with the appropriate amount of money. Furthermore, if there were not available derivative games meeting said criteria, then said software could create new derivative game(s) that do meet said criteria, and place said derivative player therein. It would then just be a matter of waiting for other derivative players to join said new derivative game(s).

In one embodiment of the present invention, whenever the exact stakes and primary player desired by a derivative player are not available, the software will create a new derivative table, and said derivative player will have to wait at said table until a matching derivative opponent is available. In a preferred embodiment, said software will maintain a queue of similar derivative games that are awaiting derivative players, and will ensure that waiting derivative games are matched with newly available derivative opponents on a first-come-first-served basis. In another preferred embodiment, said software will match up derivative games wherein a first derivative player who is willing to play at higher stakes is matched up with multiple opposing derivative players who are waiting to play at lower stakes. Thus, for example, if derivative player A is looking to play at stakes of $10-20, and has selected primary player A as his primary player wherein said primary player A is competing in a primary game against primary player B, rather than force said derivative player A to wait for one opponent who selects both primary player B and stakes of $10-20, said software could pool together ten opponents who have selected primary player B and stakes of $1-2, and create a new derivative game using all of these derivative players.

In yet another preferred embodiment of the present invention, the software could pool all of the willing and active derivative players who have chosen primary player A, and match them as a group against all of the willing and active derivative players who have chosen primary player B. Of course, it will not always be the case that the total stakes chosen by derivative players selecting primary player A will exactly match the total stakes chosen by derivative players selecting primary player B. In these mismatched situations, those derivative players who have selected the more popular primary player will only receive proportional action for their chosen stakes. For example, assume a scenario wherein the total stakes in action choosing primary player A are twice as much as the total stakes in action choosing primary player B. In this scenario, derivative players who have chosen primary player B will receive full action for their selected stakes. Yet derivative players who have chosen primary player A will only receive half-action for their selected stakes. Thus, a given derivative player, in this scenario, who wanted to play $10-20 stakes using primary player A will instead only receive action as if he had chosen to play $5-10 stakes instead. That is, said derivative player will end up with a win or loss that is half of what it might have been if he had been able to play at the full stakes he had selected. More generally, in this scenario, whatever the ratio of stakes in action for primary players A and B, if there are more total stakes in action for primary player A, said derivative players of primary player B will win or lose 100% of their individually selected selected stakes, whereas said derivative players of primary player A will win or lose P% of their individually selected selected stakes, wherein P is equal to 100 times the total of the stakes in action of the derivative players of primary player B divided by the total of the stakes in action of the derivative players of primary player A.

Of course, the practice of the present invention is not limited to primary tables where only two primary players are playing a game of poker. The primary table could have any number of primary players. As such, the derivative tables would of course have an equal number of players thereupon. In one embodiment of the present invention, a player would create a new derivative table, and select a primary player A. In order for action to commence at said derivative table, it might be required that all primary players have a corresponding derivative player at said derivative table. This way, each dollar won or lost by said primary players at said primary table will have a corresponding proportional dollar won and lost at said derivative table.

However, it is not necessary, in order for action to proceed at said derivative table, for there to be a derivative player at said derivative table corresponding to each and every primary player. In another embodiment of the present invention, action can proceed at said derivative table as soon as there are two or more derivative players at said derivative table. In this embodiment, said derivative players can only win from or lose to other derivative players present at said derivative table. Money won from or lost to derivative versions of primary players who do not have a corresponding derivative player at the derivative table will not be given to or taken from the money of said derivative players. Thus, if derivative players A and B are present at a derivative table, but their corresponding primary table has primary players A, B, and C, all money won from player C on said primary table, as well as all money lost to player C on said primary table, will result in no action on said derivative table. Thus, if said derivative table is being played at 1% of the stakes of said primary table, and primary player A wins a primary pot of $11,000 on said primary table, with $5000 having been put into said primary pot by player A, $5000 by primary player B, and $1000 from primary player C, then the action on said derivative table will yield a result wherein derivative player A wins a derivative pot of $100 consisting of $50 of his own money, plus $50 from derivative player B. The corresponding amount of $10 that should have gone into said derivative pot from derivative player C did not do so, since no person was playing the part of derivative player C at said derivative table. As a further example, again said derivative table is being played at 1% of the stakes of said primary table. In this example, primary player C wins a primary pot of $20,000 consisting of $10,000 of his own money and $10,000 from primary player A. Since said derivative table has no person playing the part of primary player C, there is no money won by derivative player C, nor any money lost by derivative player A. Even in very complicated scenarios, where there are many primary players and complicated results (such as might occur if primary players are all-in or the primary game is a split-pot version of poker), and only some of these primary players have corresponding derivative players at a derivative table, properly written computer software will have no difficulty in tracking exactly every dollar that goes into the primary pot, which primary player put each dollar into said primary pot, and which primary player or players won each dollar in said primary pot. As such, it will not be any great difficulty for this same software to track how much money was won or lost by each derivative player in the corresponding derivative game or games.

While there are numerous known betting formats in poker games, the most common are limit betting, pot limit betting, and no-limit betting. In a poker game being played with limit betting, the size of the bets and raises is predetermined for each betting round in the game in question. Thus, in a game of $2000-4000 limit Texas holdem, all bets and raises in the first two betting rounds must be in increments of $2000, and all bets and raises in the last two betting rounds must be in increments of $4000. Thus, if a primary game were $2000-4000 limit Texas holdem, a derivative game might be selected to be played at stakes of $2-4, or one-thousandth of the amount of said primary game. Every time a primary player bets $2000, any corresponding derivative player will bet $2. Every time a primary player calls $4000, any corresponding derivative player will call $4, and the like.

In a poker game with no-limit betting, primary players may bet any amount they wish at any time, commonly subject to certain minimum requirements. Typically such games have fixed amounts for blind bets or antes that all players must make at specified times. Thus, in a game of $200-400 no-limit Texas holdem, primary players are required whenever it is their turn to post blind bets of $200 and $400. After these blind bets are posted, the hand of poker commences, and all further betting and raising can be in any amount of $400 or more. Thus, if a primary game were $200-400 no-limit Texas holdem, a derivative game might be selected to be played at 0.1%, or $1/1000^{th}$, of these stakes. As such, said derivative game would include blinds of 20¢and 40¢. However, just as in the example above for a limit game, every time a primary player bets $2000, any corresponding derivative player will bet $2. Likewise, any time a primary player calls $5640, any corresponding derivative player will call $5.64. With respect to pot limit betting, it also is subject to certain minimum betting requirements, but has a potentially different maximum bet at various times. With pot limit betting, a player wishing to bet or raise may do so in any amount ranging from the minimum up to an amount equal to the size of the pot.

Although it would probably be preferable for derivative players to do so, it is not a requirement of the present invention that a derivative player match the entire amount of money that his corresponding primary player has in play on the primary table. By this it is meant that if a primary player has $100,000 in play on a primary table, and a derivative player has selected this primary player at a derivative table being played for $1/1000^{th}$ of the stakes, it is not necessary that said derivative player put the entire corresponding amount of $100 into play. If the derivative player should so choose, and the software running said derivative game permits it, said derivative player could choose this primary player, but only put some amount of money less than $100 into play at said derivative table. If this were done, then said derivative player would potentially be all-in at said derivative table, while his corresponding primary player still has money to bet at said primary table. In a manner similar to the issue discussed previously regarding derivative tables where not all primary players have corresponding derivative players, if a derivative player should not have enough funds to match the money put into a pot by his corresponding primary player, said derivative player could only win or lose that amount he had in play.

Thus, as an example, presume primary player A is playing a primary game of no-limit Texas holdem and has $100,000 in play. Derivative player A is at a derivative table being played for $1/1000^{th}$ of the stakes of said primary game, but has chosen to only put $10 in play, instead of $100. If said primary player A puts $100,000 into the primary pot in said primary game, then said derivative player A will be all-in on said derivative table, but not for the full corresponding $1/1000^{th}$ amount. If said primary player A wins said primary pot, said derivative player A will win the corresponding derivative pot. However, whereas said primary player A will win all monies put into said primary pot up to his $100,000, said derivative player A will only win monies put into said derivative pot up to his $10, instead of up to the $100 that he might have won. Thus, even if primary player B had put $100,000 into said primary pot, derivative player B would only lose $10 in said derivative game to said derivative player A, because that was all that said derivative player A could match.

In another example, presume the same facts as above prior to the start of the hand. In this example, however, said primary player A bets $15,000 in said primary game, but then folds to a raise by said primary player B, thus losing the $15,000 already put into said primary pot. On said derivative table, said derivative player A would lose his entire $10, as all of this amount was put into said derivative pot by said derivative player A following the actions of said primary player A. The fact that said derivative player A was already all-in when said primary player A folded, and thus could not fold his hand if he were in a primary game himself and all-in, is irrelevant in this situation, as he must make the same plays chosen by his corresponding primary player. Since said primary player A chose to fold his cards after having put some of his money into said primary pot, said derivative player A similarly would fold his cards, and thus lose, said derivative pot.

Because it is undesirable for a derivative player to not have proportionally as much money in play as his corresponding primary player, said derivative player will want to ensure that he does not fail to have enough money in play. However, unless said derivative player focuses full attention on the derivative game, he cannot be sure that this does not happen. As discussed hereinabove, his corresponding primary player might win a pot containing money primarily from a primary player who does not have a corresponding derivative player at said derivative table. As such, said derivative player will now have proportionally less money in his derivative game than his corresponding primary player has in said primary game. This is just one manner in which said derivative player might come to have proportionally less money in play than his corresponding primary player, even if when said derivative player originally began playing in said derivative game he did proportionally match the money of his corresponding primary player. In one embodiment of the present invention, in order to ensure that said derivative player does not suffer from this situation, it will be an option provided by the software running the game for the money in play for said derivative player to be automatically proportionally matched to the money in play for said primary player at said primary table. For example, said derivative player joins said derivative game, choosing to become derivative player A. Said derivative game is operating at 1% of the size of said primary game, wherein said primary player A has $10,000 in play. If said derivative player A chooses to utilize the option available under this embodiment of the invention, he will initially put $100 into play in said derivative game. As play occurs, if ever, for any reason, said derivative player A does not have exactly 1% as much money in play as said primary player A, the software will automatically remove the necessary money from the account of said derivative player, and put that money into play on said derivative table. As a further option, said software could also automatically reduce the amount of money in play for said derivative player if this amount should become proportionally more than the amount of money in play for said primary player.

In an alternate embodiment of the present invention, instead of the software automatically proportionally matching said derivative player's stack size to that of his corresponding primary player, the software would create an executable command for said derivative player, wherein as soon as said derivative player chose to execute said executable command, the stack size of said derivative player would then be proportionally matched to the stack size of his corresponding primary player. The executable command would preferably be a pop-up window on the computer of said derivative player, informing him that his stack size was proportionally larger or smaller than his corresponding primary player, and giving him a button to push to execute said executable command. Alternatively, said executable command could be a button built into the operating software of the game site that said derivative player could click anytime the stack sizes were not proportional. Said executable command could also be an email or text message, wherein a specific email or text message reply causes execution of said executable command, as well as other possibilities understood by those of skill in the art.

While not required for the practice of the present invention, in many instances the company providing derivative poker games to its customers will want to charge money for the provision of this service. In non-derivative poker games, whether live or online, this charge is typically referred to as rake, and comes in many forms. Most commonly, rake is taken as a percentage of the pot, often up to a fixed maximum amount. Also common is the charging of a fixed amount per unit of time for each player participating in said game. In other cases, players may be charge a fixed fee per day, week, month, or other unit of time, irrespective of how much of that time they are spending playing in the game. Sometimes rake includes other fees, such as jackpot drops and the like, which are either included in the rake as described above, or charged in addition to these other forms of rake.

In one embodiment of the present invention, the provider of the derivative game charges rake out of the pot in said derivative game. This rake taken from the pot can be a fixed amount per hand, or a fixed percentage of the pot (with or without a fixed upper limit or cap on the percentage). An example of the latter would be to collect 5% of the pot in the derivative game as rake, with a cap or maximum of $1 taken per hand. In this embodiment, the rake is taken directly from the pot, and as such, the pot won by the winning derivative player is that much smaller than it might have been. If the rake taken in said derivative game is not proportional to any rake taken in the corresponding primary game, then this disproportion will cause stack size disproportion between said derivative players and their corresponding primary players. This disproportion can be ignored, or dealt with by the means discussed elsewhere in this patent.

In an alternate embodiment of the present invention, the rake for said derivative game is calculated based upon the size of the derivative pot, or is a fixed amount, but is not collected directly from said pot. Instead, in this embodiment, said rake is taken directly from the account of the derivative player who has just won said pot. In this manner, no stack size disproportions are created. Similarly, if the corresponding primary game is being raked, but at an effectively lower rate due to the size differences in the stakes of the games being played, the rake charged in the derivative game could be first taken from said derivative pot at an amount exactly proportional to said primary game, and the excess rake beyond this proportional amount could then be taken from the account of said winning derivative player.

In another alternate embodiment of the present invention, whenever a derivative player joins a derivative game, he would create a rake stake. This rake stake would be a selected amount from which said derivative player would be required to pay rake whenever he wins a pot in said derivative game. Since this rake stake is separate from the rest of money said derivative player might have in his account, it would be necessary to ensure that there is enough in said rake stake to pay rake as needed. If said rake stake drops to zero, the software might be programmed to remove said derivative player from said derivative game. Or, said derivative player could be provided an opportunity to replenish said rake stake in order to continue participation in said derivative game.

In another alternate embodiment of the present invention, rake would be charged on a per time or per hand basis for participation in the derivative games. As such, this rake would preferably be taken from the derivative player's account as he continues to participate in each hand, or continues to play for each unit of time. Similarly, the rake could be a time based fee, such as a monthly fee, that each derivative player pays regardless of his amount of participation in said derivative games.

In an alternate embodiment of the present invention, all cards dealt on a derivative table would be identical to those dealt on the corresponding primary table, but the derivative players could have the option of not making the same playing decisions as their corresponding primary players. Thus, for example, even if primary player A chose to fold on the first round of betting, derivative player A could opt out of following that decision, and instead choose to call or raise. Many poker players would enjoy this alternate embodiment because it permits them to rely upon their corresponding primary player for most decisions, yet they will be able to make their own decisions whenever they wish to do so.

While this alternate embodiment is feasible, it does involve many difficulties. One purpose (among many) of the present invention is to permit less skillful players to select a more skillful player to make their playing decisions for them. While it is obviously not impossible to permit a derivative player to opt out and make his own decisions, by permitting him to do so it will now become impossible, as a practical matter, for any other derivative player to let his corresponding primary player make his decisions for him for the remainder of that hand. The fact that one of the derivative players chose to make his own decision, different than that of his corresponding primary player, will cause the rest of that hand to play out completely differently on said derivative table as compared to said primary table. Since the decisions made by said primary players will no longer be relevant to the hand being played at said derivative table, as the circumstances on said derivative table are now different than those on said primary table, it will be useless for all of said derivative players to follow the playing decisions of their corresponding primary players for the remainder of this hand.

Another difficulty with this alternate embodiment involves the timing of these concurrent games. Whenever a hand is finished on said primary table, said primary table is ready to deal the next hand. But since action may be continuing on said derivative table, said derivative game cannot deal the next hand until said derivative table is finished with the present hand. One way to handle this issue is to delay the start of the next hand on said primary table until the hand is finished on said derivative table. However, the persons playing on said primary table will likely not appreciate this delay. If there are numerous derivative tables in play, then it is likely that it will often take quite a while for play to finish on all of those derivative tables, thus making the players on said primary table often wait before they can start their next hand.

Yet another difficulty with this alternate embodiment is that in many poker games the decisions made earlier in the hand can completely change the final results of the hand. In flop games like Texas holdem and Omaha, the decision made by the players affect the outcome as to which player wins or loses, and more importantly, how much they win or lose. However, no matter what decisions the players make, they will always have the same private cards, and the same public cards will be dealt face-up on the table. Thus, if the player who is theoretically going to end up with the highest ranking hand never chooses to fold, it is impossible for anybody to beat him on this hand. Only by convincing this person to fold will somebody else win the pot. But in poker games like stud and draw, the removal of players from the hand when they fold, or their continued participation because they do not fold, can completely change the outcome, because the presence or absence of these players changes which cards will be dealt to which players as the hand progresses. For example, in a game of seven card stud, if primary player A folds, but derivative player A elects to call and continue, then derivative players B and C will not receive the same cards for the remainder of the hand as their corresponding primary players. Thus, while primary player B may make the highest ranking hand in said primary game, the continued presence of derivative player A may cause derivative player C to win the hand instead on said derivative table. Although there is nothing inherently wrong with these types of situations, it is expected that most poker players will not enjoy them, and would prefer that such options are not available to their derivative opponents.

In another alternate embodiment of the present invention, derivative players must make the same decisions as their corresponding primary players, with the exception of the final decision of each hand. In a poker game, there are only ever at most three decisions available to a player. They may choose to fold, call, or raise if they are facing a bet, or they may choose to check or bet if they are not facing a bet. Typically, as soon as ii the last decision is made in a hand of poker, all players remaining in the hand will expose their private cards, and the highest ranking hand or hands win all or their portion of the pot. If the last decision in a hand is to fold, and only one player remains in the hand after this decision, then said one remaining player wins the entire pot, and is not required to reveal their private cards (though they may voluntarily do so). In this alternate embodiment of the invention, derivative players must make the same decisions as their primary players, except that if the last decision in said primary hand is made by their corresponding primary player, and that decision is to fold or to call, said derivative player is given the option to not make this same decision, and to instead call or fold. In this manner, said derivative player can possibly win a pot by calling where their corresponding primary player chose to fold, but said derivative player would be risking their money by doing so, and could instead lose money in a situation where their corresponding primary player did not. Conversely, said derivative player could choose to fold in a situation where their corresponding primary player called, and if correct said derivative player would save money that their corresponding primary player lost; but doing this would also mean that said derivative player might fail to win a pot that their corresponding primary player did win by making that call.

As mentioned above, when facing a bet, a player typically has the option to fold, call, or raise. However, it would not be practical, in this alternate embodiment, to permit said derivative player to choose the option of raising instead of following the action of their corresponding primary player who chose to fold or call. Permitting the option of raising would then require that the opponent of said derivative player would have to make a decision on their own, without guidance from their corresponding primary player, since their corresponding primary player never faced this raise on said primary table. By limiting the choice of said derivative player to either calling or folding, when their corresponding primary player chose to fold or call, it is ensured that this decision will still be the final decision made in the hand.

In another alternate embodiment of the present invention, players in the primary game would have the option of soliciting the votes of their corresponding derivative players to help them in making decisions. As an example, primary player A has raised all-in in a hand of no-limit Texas holdem. The only opponent remaining in the hand is primary player B. Said primary player B has concluded that this is a very close decision, and that since there are so many derivative players out there who will win or lose a lot of money based upon the correctness of his decision, that he would like their input. Thus, said primary player B clicks a button or uses other means of activating the software such that all of his corresponding derivative players are shown his private cards, and asked to quickly vote whether they prefer the decision of calling or folding. In one version of this alternate embodiment, the result of said vote is provided to said primary player B, who can consider it, but who still makes the decision himself. In another version of this alternate embodiment, once said primary player B asks his corresponding derivative players to vote, he is bound by the result of said vote, and must make the decision that garnered the most votes by said corresponding derivative players. In either version of this alternate embodiment of the invention, it could also be required that derivative players pay a fee to their corresponding primary player for the privilege of voting on a decision.

In another alternate embodiment of the present invention, the derivative player is required to pay his corresponding primary player for the privilege of using the skill of said corresponding primary player to make his decisions for said derivative player. Although it is not extra effort for said corresponding primary player to make said decisions, as said corresponding primary player will be making them anyway as he plays his own game, it is possible that said corresponding primary player will not appreciate the fact that derivative players are profiting from his skill without compensation. Maybe even more importantly, most primary players are not going to want to have their private cards revealed to anybody else. In many embodiments of the present invention, the private cards dealt to the primary players will be revealed to all of their corresponding ii derivative players at some point in time. Yet, in most games, these cards are never revealed except at showdown, and knowledge of these cards will help other players to better understand the strategy of the primary player, and potentially alter the future results of said primary player for the worse. As compensation for these and other disadvantages of being a primary player, the software running the games could be programmed to automatically pay said primary player from the account of said derivative players. This compensation could come in almost any form. In one embodiment, this payment made by said derivative player would be a fixed fee for each hand that is played for him by said corresponding primary player. In another embodiment, said derivative player would pay said primary player a fixed fee per unit of time. In yet another embodiment, said derivative player would pay a percentage of the profit made for him to said primary player. Any fees paid under these embodiments could be made to be proportional to the size of the derivative game, that is, derivative games played for lower stakes will pay a lower fee and derivative games played for higher stakes will pay a higher fee.

Similarly, instead of compensating primary players directly from the derivative players, instead said primary players could be compensated directly by the site running the primary and derivative games. The site could pay the primary players by giving them a percentage of the rake collected from the derivative games, by paying them a fixed fee per hand, per match, or per unit of time spent playing. Sites could also pay primary players by paying them a daily, weekly, monthly, or annual fee, or making such compensation part of a contract, wherein said primary players are compensated on a contractual basis, and part or all of the contractual requirement is that said primary player participate in primary games. The important part of this aspect of the present invention is that the primary player is somehow being compensated in exchange for his participation in primary games.

Of course, while most of the examples given in the present specification have involved the poker game of Texas holdem, there are countless other variations of the game of poker, and all of them are within the scope of the present invention. Likewise, the practice of the present invention is not limited to just the game of poker, but is equally applicable to other mental skill games wherein the playing and/or betting decisions of the players impacts their chances of winning or losing the game, as well as how much they win or lose.

While the practice of the present invention does encompass both live and online games, as a practical matter it would be very difficult to practice the invention in a completely live setting. Using poker as an example, it would be very difficult in real time to determine which cards were dealt to which players at a primary table, and then find and deal the identical cards to the corresponding derivative players at a derivative table. While methods are known to easily and rapidly determine which cards are being dealt to which players at said primary table (e.g., RFID readers and RFID-marked cards) in a live game, it is obviously rather difficult to ensure that the same cards are then dealt, in a timely manner, to each corresponding derivative player. However, it would be quite possible to have a live primary game, using technology such as RFID or the like to read the cards, or wherein the live primary game is played on an e-table, and then have one or more corresponding derivative tables that are being played online.

Fantasy leagues based upon live sporting events have become extremely popular. In a typical league, competitors draft a virtual team of live players selected from the available real world teams. Based upon the performance of their selected team members in the real games, the players collect points. The points vary depending upon the scoring system used in their fantasy league. Fantasy leagues exist for football, baseball, soccer, cricket, and almost every sport known. In one embodiment of the present invention, fantasy poker can be played using the present invention as part of the scoring mechanism for the fantasy poker competition. According to this embodiment, fantasy players sign up for a fantasy derivative poker league. Said fantasy players then play derivative poker by any of the methods described in the present invention, and use the results of their derivative play for scorekeeping purposes in said fantasy derivative poker league. In one aspect of this embodiment, said fantasy players could draft primary players, and then keep score based upon all primary games played by said primary players during a defined time period. At the conclusion of said defined time period, winning fantasy players would be determined by scoring the results of their derivative games which were played using their drafted primary players. In another aspect of this embodiment, fantasy players do not need to draft primary players, but can use any available primary player during a time period and with whatever limitations are set in place by the fantasy league. In this aspect, competing fantasy players could make use of the same primary players at the same or different times. At the conclusion of the fantasy league, results would be based upon the derivative results obtained by each said fantasy player. In another aspect of this embodiment, the derivative games are played with play money. In some cases, the league would be for fun only. In other cases, based upon the play money scores obtained in league play, fantasy players would win prizes or money. In some cases, the prize money would be a portion of the money paid by said fantasy players to compete in said fantasy league. In another aspect of this embodiment, said fantasy players could be required to pay an entry fee to compete in said fantasy league, and could win all or a portion of said fees based upon their league results, but they additionally play derivative poker, as part of their league play, using their own real money, and thus can win or lose even more than just the fees paid to compete in the league. In all aspects of this embodiment, leagues could be set up to run for specific periods of time with no limitations on how much derivative play the league competitors engage in, or there could be limitations as to how many hands of derivative poker may be played, or how much time may be spent playing derivative poker. In all aspects of this embodiment, the league results could be based upon the most real or play money won during league play, or the number of hands won, or the percentage of hands won, or many other parameters.

Of course, the primary purpose of online poker is to provide entertainment. Despite the fact that many thousands of players make a living or significantly supplement their income by playing online poker, the vast majority of players compete for the challenge and entertainment. In one embodiment of the present invention, this entertainment is enhanced by displaying video of the primary player or players as they participate in their primary game. This way, derivative players can watch as their corresponding primary player and his opponents compete against one another, and enjoy the visual and/or auditory spectacle. They will see the pain and pleasure on the face of their primary player as he loses or wins a large pot for them.

In another embodiment of the present invention, animated avatars and the like could be used. For example, when a derivative player participates in a derivative game, he could be presented on his computer screen with a visual representation of the game. But, instead of seeing his own avatar sitting at the table, as is commonly done, he might instead see both his avatar and that of his corresponding primary player sitting side-by-side. These avatars could then be animated by the software. For example, when the players win a large pot, the software might display an animated video of their respective avatars exchanging a high-five, doing a happy dance, or any other desired animated display. Similarly, if they were to lose a large pot, then a "sad" animation might be displayed instead.

While much of this description has focused on poker as the game being played, the invention is also applicable to other games that involve strategic decision making and betting decisions at multiple points in time during the game. The key to the present invention that separates it from the prior art is the ability of players to select a primary player in a primary game, wherein the primary player will make the playing and betting decisions for the person who selected that primary player.

Embodiments of methods of playing games are described. Although specific embodiments are illustrated and described herein, it will be appreciated by those of ordinary skill in the art that any arrangement which is calculated to achieve the same purpose may be substituted for the specific embodiments shown. This application is intended to cover any adaptations or variations. For example, although described in specific terms, one of ordinary skill in the art will appreciate that other implementations can be made, or that other apparatus that provides the required function can be made. In particular, one of skill in the art will readily appreciate that the names of the methods and terms therein are not intended to limit embodiments. Furthermore, additional methods and steps can be added to the described embodiments, steps can be rearranged within the methods, and new components or devices corresponding to existing or future means can be used in the embodiments without departing from the scope of claimed invention. One of skill in the art will readily recognize that methods of the claimed invention can be practiced using future devices, different constructions, and new technologies other than those disclosed herein.

Throughout this application, many documents, including patents, published patent applications, and books, have been mentioned and/or cited. The entirety of these documents is hereby incorporated by reference herein in order to more fully describe the embodiments of the invention and the state of the art to which this invention pertains.

The terminology used in this application is meant to include all embodiments, terminologies, and specific environments and alternate technologies which provide the same functionality as described herein.

Those skilled in the art to which the present invention pertains may make modifications resulting in other embodiments employing principles of the present invention without departing from its spirit or characteristics, particularly upon considering the foregoing teachings. Accordingly, the described embodiments are to be considered in all respects only as illustrative, and not restrictive, and the scope of the present invention is, therefore, indicated by the appended claims rather than by the foregoing description or drawings. Consequently, while the present invention has been described with reference to particular embodiments, modifications of structure, sequence, materials and the like apparent to those skilled in the art still fall within the scope of the invention as claimed by the applicant.

What is claimed is:

1. A method for playing poker, said method comprising:

playing poker at a primary table consisting of two or more primary players, wherein said primary players at said primary table make their own playing decisions; and playing poker at a first derivative table consisting of two or more derivative players, wherein each of said derivative players at said first derivative table has a corresponding primary player at said primary table, and further wherein said derivative players at said first derivative table are dealt the same cards as their corresponding primary players at said primary table, and wherein the playing decisions of said derivative players at said first derivative table are exactly the same as the playing decisions made by their corresponding primary players at said primary table, wherein software is running said first derivative table.

2. The method of claim 1, said method comprising the further step of:

playing poker at a second derivative table consisting of two or more derivative players, wherein each of said derivative players at said second derivative table has a corresponding primary player at said primary table, and further wherein said derivative players at said second derivative table are dealt the same cards as their corresponding primary players at said primary table, and wherein the playing decisions of said derivative players at said second derivative table are exactly the same as the playing decisions made by their corresponding primary players at said primary table, wherein software is running said second derivative table.

3. The method of claim 1, said method comprising the further step of:

playing poker at an $n^{th}$ derivative table consisting of two or more derivative players, wherein each of said derivative players at said $n^{th}$ derivative table has a corresponding primary player at said primary table, and further wherein said derivative players at said $n^{th}$ derivative table are dealt the same cards as their corresponding primary players at said primary table, and wherein the playing decisions of said derivative players at said $n^{th}$ derivative table are exactly the same as the playing decisions made by their corresponding primary players at said primary table, and further wherein n is a number from 1-100,000, wherein software is running said $n^{th}$ derivative table.

4. The method of claim 1, wherein said primary players at said primary table are playing for real money, and wherein said derivative players at said derivative table are playing for a selected stake that is a fixed percentage of the amount bet by said primary players at said primary table.

5. The method of claim 4, wherein said fixed percentage is greater than 0%, but less than 100%.

6. The method of claim 1, wherein said primary players at said primary table are playing for real money, and wherein said derivative players at said derivative table are playing for play money.

7. The method of claim 1, wherein the identity of the private cards being dealt at said derivative table is not revealed to said derivative players.

8. The method of claim 1, wherein the identity of the private cards being dealt at said derivative table is revealed to said derivative players.

9. The method of claim 8, wherein said derivative players are required to pay a fee to said corresponding primary players in exchange for said identity of said private cards being revealed.

10. The method of claim 8, wherein the hand being played by said primary players at said primary table is completed before play of said hand commences on said derivative table.

11. The method of claim 1, wherein the hand being played by said primary players at said primary table is completed before play of said hand commences on said derivative table.

12. The method of claim 1, wherein said derivative players at said derivative table are playing online poker, and further wherein said primary players at said primary table are playing live poker.

13. The method of claim 1, wherein said primary game comprises 2-10 primary players.

14. The method of claim 13, wherein said derivative game comprises 2-10 derivative players.

15. The method of claim 14, wherein the number of said derivative players is equal to the number of said primary players.

16. The method of claim 13, wherein the number of said derivative players is less than the number of said primary players.

17. The method of claim 1, wherein the game of poker being played is selected from the group consisting of Texas holdem, seven card stud, Omaha hi-lo split eight-or-better, Omaha high, razz, seven card stud hi-lo split eight-or-better, deuce-to-seven triple draw, badugi, deuce-to-seven single draw, badeucey, badacey, ace-to-five triple draw, California lowball, five card draw, and five card stud; further wherein the betting structure of said game of poker being played is selected from the group consisting of limit betting, pot limit betting, and no-limit betting.

18. The method of claim 17, wherein said game of poker is Texas holdem, and further wherein said betting structure is no-limit betting.

19. The method of claim 4, wherein said software has been set to automatically add or subtract real money to or from the stack of said derivative player at the beginning of each hand of poker, so as to ensure that said derivative player and the corresponding primary player always have the same proportion of money at said beginning of each hand of poker.

20. The method of claim 4, wherein said software has been set to automatically provide an executable command to said derivative player, wherein if said derivative player chooses to utilize said executable command, doing so will instruct said software to then add or subtract real money to or from the stack of said derivative player, so as to ensure that said derivative player and the corresponding primary player have the same proportion of money.

21. The method of claim 3, wherein a first derivative player has instructed said software to automatically place said first derivative player into existing derivative games, or to automatically create new derivative games and join said first derivative player into said new derivative games, wherein said software has been instructed to engage in said automatic placement whenever but only when a specific primary player is available.

22. The method of claim 21, wherein said first derivative player has further instructed said software to only place said first derivative player into said derivative games if said specific primary player is playing in a specific primary game.

23. The method of claim 21, wherein said first derivative player has further instructed said software to only place said first derivative player into said derivative games if said specific primary player is playing against specific primary opponents.

24. The method of claim 3, wherein a first derivative player has instructed said software to automatically place said first derivative player into existing derivative games, or to automatically create new derivative games and join said first derivative player into said new derivative games, wherein said software has been instructed to engage in said automatic placement whenever but only when any available primary player is playing against a specific primary player opponent.

25. The method of claim 24, wherein said first derivative player has further instructed said software to only place said first derivative player into said derivative games if said specific primary player opponent is playing in a specific primary game.

26. The method of claim 1, wherein a first derivative player has instructed said software to automatically place said first derivative player into existing derivative games, or to create new derivative games and join said first derivative player into said new derivative games, whenever the corresponding primary games meet selected criteria.

27. The method of claim 26, wherein said software is operated by a website, and further wherein said derivative player is not logged into said website running said software at the time said derivative games are being played.

28. The method of claim 26, wherein said software has been instructed how much of said derivative player's real money to put in play at any one time.

29. The method of claim 26, wherein said software has been instructed to cease all automatic placements if a specific stop-loss amount is reached.

30. The method of claim 26, wherein said software has been instructed to prioritize amongst multiple automatic placements created by said derivative player.

31. The method of claim 1, wherein said derivative player pays a fee to their corresponding primary player.

32. The method of claim 31, wherein said fee is a fixed amount of money for each hand played.

33. The method of claim 31, wherein said fee is a fixed amount of money for each unit of time played.

34. The method of claim 31, wherein said fee is a percentage of any profit made by said derivative player.

35. The method of claim 1, further comprising a site operating said primary table, wherein said site pays real money to said primary player in exchange for their participation at said primary table.

36. The method of claim 35, wherein the amount of said real money is calculated as a portion of the rake generated at said corresponding derivative table.

37. The method of claim 35, wherein the amount of said real money is a fixed amount per hand played at said primary table.

38. The method of claim 35, wherein the amount of said real money is a fixed amount per unit of time played at said primary table.

39. The method of claim 35, wherein the amount of said real money is a fixed amount per unit of calendar time and not only correlated to the amount of time played at said primary table.

40. The method of claim 4, further comprising a first primary player, a second primary player, multiple derivative players of said first primary player, and multiple derivative players of said second primary player, wherein the total of the selected stakes selected by said multiple derivative players of said first primary player exceeds the total of the selected stakes selected by said multiple derivative players of said second primary player, further wherein said multiple derivative players of said second primary player will win or lose 100% of their individually selected selected stakes, whereas said multiple derivative players of said first primary player will win or lose P % of their individually selected selected stakes, wherein P is equal to 100 times said total of the selected stakes selected by said multiple derivative players of said second primary player divided by said total of the selected stakes selected by said multiple derivative players of said first primary player.

41. A method for playing poker, said method comprising:

playing poker at a primary table consisting of two or more primary players, wherein said primary players at said primary table make their own playing decisions; and playing poker at a first derivative table consisting of two or more derivative players, wherein each of said derivative players at said first derivative table has a corresponding primary player at said primary table, and further wherein said derivative players at said first derivative table are dealt the same cards as their corresponding primary players at said primary table, and wherein said derivative players at said first derivative table have the option to accept the playing decisions made by their corresponding primary players at said primary table, or to make a different decision of their own choosing, wherein software is running said first derivative table.

42. The method of claim 41, wherein the game being played by said primary players at said primary table is completed before play commences on said derivative table.

43. The method of claim 41, wherein said derivative players have the option to make a decision of their own choosing only on the final decision of each hand of poker in said primary game, and must make the same playing decision made by their corresponding primary player for every other decision in the hand.

44. The method of claim 43, wherein said final decision in said primary game was to call or fold, and wherein said derivative player can only change this decision to fold or call.

45. A method for playing poker, said method comprising: playing poker at a primary table consisting of two or more primary players, wherein said primary players at said primary table make their own playing decisions; and playing poker at a first derivative table consisting of two or more derivative players, wherein each of said derivative players at said first derivative table has a corresponding primary player at said primary table, and further wherein said derivative players at said first derivative table are dealt the same cards as their corresponding primary players at said primary table, and wherein the playing decisions of said derivative players at said first derivative table are exactly the same as the playing decisions made by their corresponding primary players at said primary table, and further wherein a first primary player can optionally elect to have his corresponding derivative players vote as to which decision said first primary player will make, wherein software is running said first derivative table.

46. The method of claim 45, wherein said vote is not binding on said first primary player, but is available for consideration by said first primary player when making said decision.

47. The method of claim 45, wherein said vote is binding on said first primary player, and said first primary player must make said decision solely based upon the results of said vote.

48. A method for playing a game, said method comprising:

playing said game at a primary table consisting of two or more primary players, wherein said primary players at said primary table make their own playing decisions; and playing said game at a first derivative table consisting of two or more derivative players, wherein each of said derivative players at said first derivative table has a corresponding primary player at said primary table, and further wherein the play of said game at said first derivative table will be identical to the play of said game at said primary table, and wherein the playing decisions of said derivative players at said first derivative table are exactly the same as the playing decisions made by their corresponding primary players at said primary table, wherein software is running said first derivative table.

49. The method of claim 48, wherein said game is selected from the group consisting of bridge, chess, backgammon, mahjong, chinese poker, blackjack, checkers, dominoes, go, scrabble, cribbage, and gin rummy.

* * * * *